US008776472B1

(12) United States Patent
Kinser, Jr.

(10) Patent No.: US 8,776,472 B1
(45) Date of Patent: Jul. 15, 2014

(54) INSULATED PANEL ARRANGEMENT FOR WELDED STRUCTURE

(71) Applicant: James V. Kinser, Jr., LaGrange, KY (US)

(72) Inventor: James V. Kinser, Jr., LaGrange, KY (US)

( * ) Notice: Subject to any disclaimer, the term of this patent is extended or adjusted under 35 U.S.C. 154(b) by 0 days.

(21) Appl. No.: 13/962,163

(22) Filed: Aug. 8, 2013

Related U.S. Application Data

(63) Continuation-in-part of application No. 13/177,121, filed on Jul. 6, 2011, now Pat. No. 8,528,288, which is a continuation-in-part of application No. 13/086,125, filed on Apr. 13, 2011, now abandoned.

(60) Provisional application No. 61/831,948, filed on Jun. 6, 2013.

(51) Int. Cl.
*E04B 2/00* (2006.01)
*E04B 1/38* (2006.01)
*E04C 2/284* (2006.01)

(52) U.S. Cl.
CPC .. *E04C 2/284* (2013.01); *E04B 1/38* (2013.01)
USPC ..... 52/582.2; 52/584.1; 52/580

(58) Field of Classification Search
CPC ..... E04B 1/6141; E04B 1/6183; E04B 1/80; E04F 2201/0523; E04F 2201/0138; E04F 2201/0115
USPC ..... 52/127.7, 127.9, 417, 459, 578, 582.2, 52/584.1, 782.1, 792.1; 403/270–272
See application file for complete search history.

(56) References Cited

U.S. PATENT DOCUMENTS

| | | | | | |
|---|---|---|---|---|---|
| 1,930,345 | A | * | 10/1933 | Lewis | 52/792.1 |
| 2,175,579 | A | * | 10/1939 | Statton | 52/592.1 |
| 2,340,864 | A | | 2/1944 | Miles | |
| 2,647,287 | A | | 8/1953 | Jones | |
| 2,741,341 | A | | 4/1956 | Anderson | |
| 2,842,814 | A | * | 7/1958 | Lindgren | 160/113 |
| 2,911,076 | A | * | 11/1959 | Saunders et al. | 428/117 |
| 3,113,401 | A | | 12/1963 | Jessup | |
| 3,309,115 | A | * | 3/1967 | Langer | 52/582.2 |
| 3,327,447 | A | | 6/1967 | Nissley | |
| 3,353,314 | A | | 11/1967 | Melcher | |
| 3,392,497 | A | * | 7/1968 | Vantine Cushman | 52/272 |
| 3,400,958 | A | * | 9/1968 | Haimes et al. | 52/127.9 |
| 3,472,545 | A | | 10/1969 | Berkowitz | |
| 3,496,692 | A | | 2/1970 | Melcher | |
| 3,671,006 | A | | 6/1972 | Berkowitz | |
| 3,712,653 | A | * | 1/1973 | Lehmann | 52/582.2 |
| 3,742,672 | A | * | 7/1973 | Schaeufele | 52/592.1 |
| 3,784,240 | A | | 1/1974 | Berkowitz | |
| 3,785,103 | A | | 1/1974 | Turner | |
| 4,020,613 | A | * | 5/1977 | Reynolds et al. | 403/321 |
| 4,223,537 | A | | 9/1980 | Sanborn | |
| 4,417,430 | A | | 11/1983 | Loikitz | |
| 4,512,122 | A | * | 4/1985 | Berkowitz | 52/127.9 |
| 4,574,537 | A | | 3/1986 | Krieger | |
| 5,212,924 | A | | 5/1993 | Finkelstein | |

(Continued)

*Primary Examiner* — Brian Glessner
*Assistant Examiner* — Adam Barlow
(74) *Attorney, Agent, or Firm* — Camoriano and Associates

(57) ABSTRACT

An insulated panel arrangement includes hook assemblies and pin assemblies to secure two panels together. The skin of at least one panel extends beyond the end face of the panel and is received in a recess in the skin of the adjacent panel so the two panels can be welded together to form a flat, continuous planar skin.

6 Claims, 21 Drawing Sheets

(56) References Cited

U.S. PATENT DOCUMENTS

| | | | | | |
|---|---|---|---|---|---|
| 5,410,849 | A | * | 5/1995 | Christopher | 52/309.2 |
| 5,424,118 | A | * | 6/1995 | McLaughlin | 428/314.8 |
| 5,613,338 | A | * | 3/1997 | Esposito | 52/588.1 |
| 6,070,919 | A | | 6/2000 | Finkelstein | |
| 6,098,368 | A | | 8/2000 | McKann | |
| 6,119,427 | A | | 9/2000 | Wyman et al. | |
| 6,122,879 | A | * | 9/2000 | Montes | 52/592.1 |
| 6,299,224 | B1 | | 10/2001 | Finkelstein | |
| 7,530,204 | B2 | | 5/2009 | Cook | |

* cited by examiner

INSULATED PANEL ARRANGEMENT FOR WELDED STRUCTURE

This application is a continuation-in-part of U.S. application Ser. No. 13/177,121 filed Jul. 6, 2011, which is a continuation-in-part of U.S. application Ser. No. 13/086,125 filed Apr. 13, 2011, and this application also claims priority from U.S. Provisional Application Ser. No. 61/831,948 filed Jun. 6, 2013, all of which are hereby incorporated herein by reference.

BACKGROUND

The present invention relates to an insulated panel arrangement for insulated panels such as those used in walk-in coolers.

Walk-in coolers and environmental test chambers are typically constructed of individual, insulated panels which are then latched together with hooks on one panel which engage pins on a second panel. The hooks are mounted on a cam arrangement so they can be rotated to pull the panels tightly together. The panels typically are fabricated from an expanded polyurethane foam insulation which is blown in between walls of relatively thin metal skins (typically 22 gauge steel or stainless steel). The panel ends are designed to match up in a tongue and groove configuration with the ends of the metal skins abutting each other.

The latch mechanisms are encased in the foam insulation. If the latch mechanisms shift relative to their respective panels, the fit between the panels may become loose, which is undesirable, as it allows air to leak through the gaps that are created between the panels and may affect the structural strength of the enclosure.

Prior art attempts to prevent shifting of the latch mechanisms relative to their respective panels have included the addition of "wings", as shown in U.S. Pat. No. 6,299,224 "Finkelstein", which is hereby incorporated herein by reference. The "wings" provide a large bearing surface for the latch mechanism to bear against the foam insulation to try to reduce the amount of shifting of the latch. However, in some instances, particularly when the foam insulation is subjected to very high temperatures or when it is exposed to high relative humidity, the foam insulation begins to break down, and the latches still become loose.

In very high temperature applications, such as in oven chambers, mineral wool insulation is used in the core space instead of foam insulation. Mineral wool insulation is not capable of bearing any weight, so it cannot be used as a structural member. Since the temperature differential in these panels is even greater than in the foam insulated panels, it is especially desirable to keep the heat transfer between the inner skin of the panel (inside the oven chamber) and the outer skin of the panel to a minimum.

SUMMARY

An embodiment of the present invention provides a means for transferring the latching forces to the metal skins of each panel. The forces are transferred in such a manner that, when two panels are tightened snugly together, the forces are applied to the metal skins directly opposite to each other. This provides greater latching strength and prevents deformation of the metal skins and shifting of the latches relative to the panels, so the panels remain snugly against each other, even if the insulation begins to break down due to heat and humidity or other factors. In at least one embodiment, there are two spaced-apart hooks on each latching mechanism, which adds even greater strength. The latching arrangements shown here are particularly useful for panels that are used outdoors, where there may be high wind load conditions such as hurricanes, and for high temperature conditions, high humidity conditions, and a combination of all these negative conditions. Also, by holding a tight seal even under high temperature conditions, this latching arrangement provides greater fire resistance than prior art latching arrangements.

In one embodiment, where mineral wool insulation is used instead of foam insulation, discrete spacers provide structural support to the skins of the panel while minimizing the contact area between inner and outer skins so as to reduce heat transfer.

In one embodiment, the structure of each panel is designed so that part of the skin of one panel overlies a recessed part of the skin of the next adjacent panel, so the skins of adjacent panels can be welded together after the panels have been latched together to form a unitary, sealed structure.

DESCRIPTION

Figures 1, 2, 3:
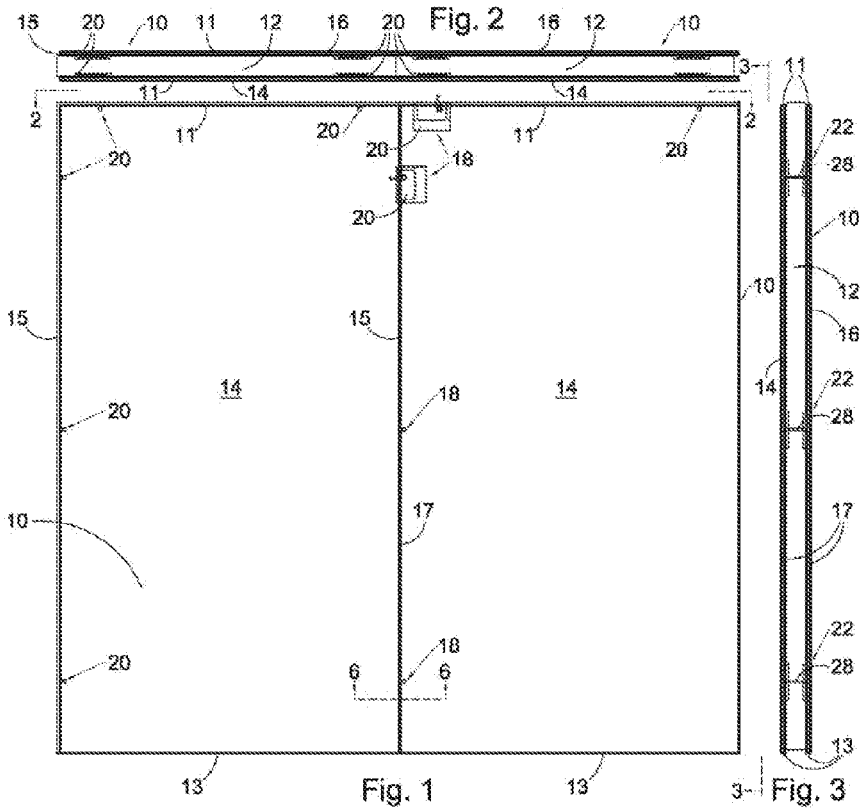
FIG. 1 is a side view of two insulated panels made in accordance with the present invention, with the panels partially broken away to show two of the latch mechanisms.
FIG. 2 is a view along line 2-2 of FIG. 1.
FIG. 3 is a view along line 3-3 of FIG. 1.

FIGS. 1 and 2 show two rectangular insulated panels 10 fitted snugly together to form a wall. Each panel 10 is made up of an inner planar skin 14 and a parallel outer planar skin 16. A urethane expanded foam insulation core 12 fills the interior space between the inner and outer skins 14, 16. In this particular embodiment, the core 12 is five inches thick and the inner and outer skins 14, 16 are 22 gauge steel sheets.

Figure 4:
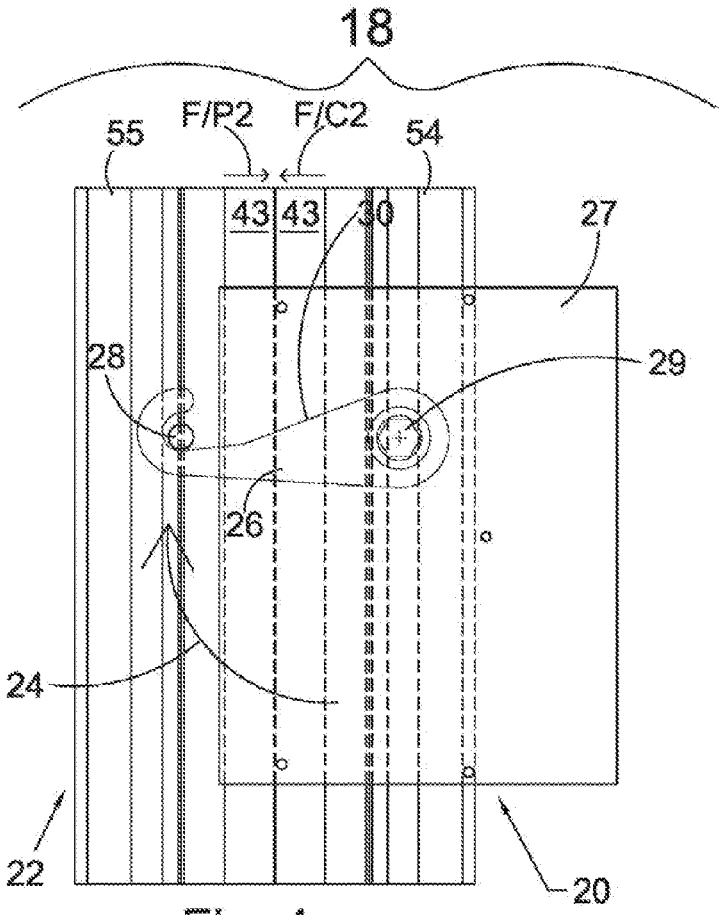
FIG. 4 is a view along line 4-4 of FIG. 6.

Each of the planar skins 14, 16 has a top edge 11 at the top end of the panel 10 and an opposed bottom edge 13 at the bottom end of the panel 10. Each of the planar skins 14, 16 also has a left edge 15 at the left end of the panel 10 and an opposed right edge 17 at the right end of the panel. Latching arrangements 18 hold the panels together. As shown in FIG. 4, a hook assembly 20, mounted on one panel 10, mates with a pin assembly 22 mounted on a second, adjacent panel 10 such that, as the hook assembly 20 is rotated in the direction of the arrow 24, the hook 26 on the hook assembly 20 engages the pin 28 on the pin assembly 22. Further rotation of a hex head wrench (not shown) on the rod 29 of the hook assembly 20 rotates the hook 26 and results in a cam action wherein the hook 26 retracts into its panel 10, pulling the pin 28 of the pin assembly 22 toward the hook assembly 20 to draw the insulated panels 10 together for a snug fit, as described in more detail later. The hook 26 is mounted on the rod 29 and rotates with the rod 29 and about the axis of the rod 29. The cam-action hook assembly 20 for this embodiment is part number 1168, supplied by Kason Industries of Woodmere, N.Y.

As shown in FIGS. 1-3, in this particular embodiment, the hook assemblies 20 are mounted on the left end and top end of each panel 10. The corresponding pin assemblies 22 are mounted on the right end and bottom end of each panel directly opposite their respective hook assemblies 20. For example, the hook assemblies 20 on the left end are at the same elevations as the respective pin assemblies 22 on the right end, which puts each hook assembly 20 directly opposite a pin assembly 22 so that, when the left end of one panel abuts the right end of another panel, the hook assemblies 20 on the left end of the one panel are properly aligned with the respective pin assemblies 22 of the other panel. Similarly, the hook assemblies 20 on the top end are directly opposite the pin assemblies 22 on the bottom end so that, when one panel 10 is placed below another with their left and right ends aligned, the hook assemblies 20 on the top end of the bottom panel are properly aligned with the pin assemblies 22 on the bottom end of the upper panel.

In this particular embodiment, each panel 10 has three hook assemblies 20 on its left end, three pin assemblies 22 on its right end, two hook assemblies 20 on its top end, and two pin assemblies 22 on its bottom end. This arrangement allows the hooks 26 on the left end of one panel 10 to engage the corresponding pins 28 on the right end of the next adjacent panel 10 to the left. It also allows the hooks 26 on the top end of one panel 10 to engage the corresponding pins 28 on the bottom end of the next adjacent panel 10 above (not shown).

The insulated panels 10 have a tongue 38 and groove 40 configuration along the panel ends so they can match up to each other. As shown best in FIG. 7, the left and right opposed edges 15, 17 of the inner and outer skins 14, 16 are bent toward the other of the skins 16, 14, respectively, to form left and right opposed end faces 42, 44. In this particular embodiment, the end faces 42, 44 are perpendicular to the planar skins 14, 16, and the edges are also bent back parallel to the planar skins 14, 16 to form return legs 43. The left and right end faces 42, 44 and return legs 43 run the full length of their respective edge 15, 17. This same arrangement occurs at the top and bottom edges 11, 13.

Gaskets 46 are placed on the outer surface of one or both of the end faces 42 to provide a tighter seal between the insulated panels 10.

Figure 5:
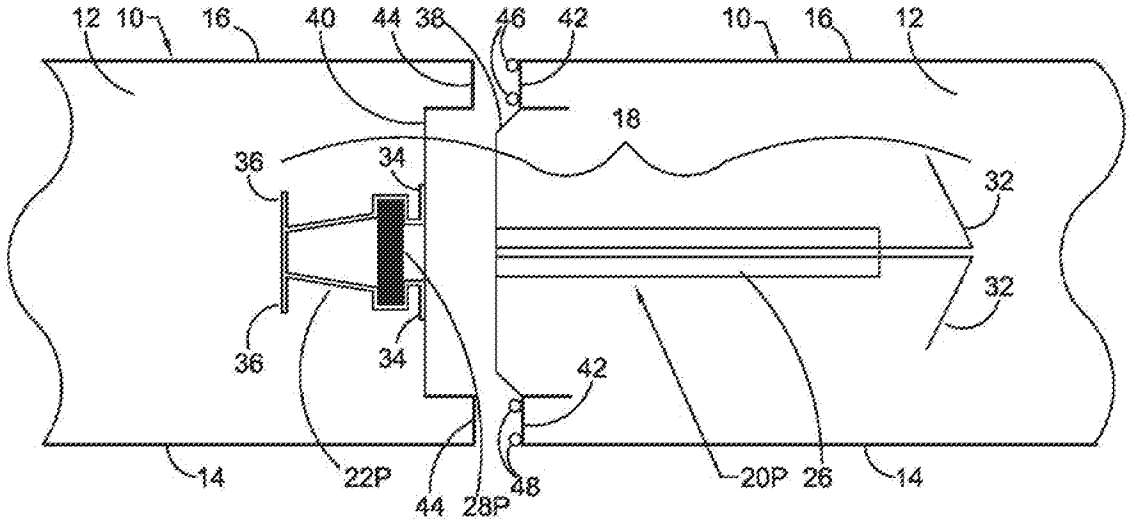
Fig. 5 Prior Art
FIG. 5 is a view showing a prior art latching arrangement just before it is latched.

It should be pointed out that, in the prior art arrangement shown in FIG. 5, the hook assembly 20P and the pin assembly 22P are both encased in and anchored to the foam insulation 12. Wings 32 on the hook assembly 20P and similar wings 34 and 36 on the pin assembly 22P help anchor their respective assemblies 20P, 22P to the foam insulation 12.

Figure 6:
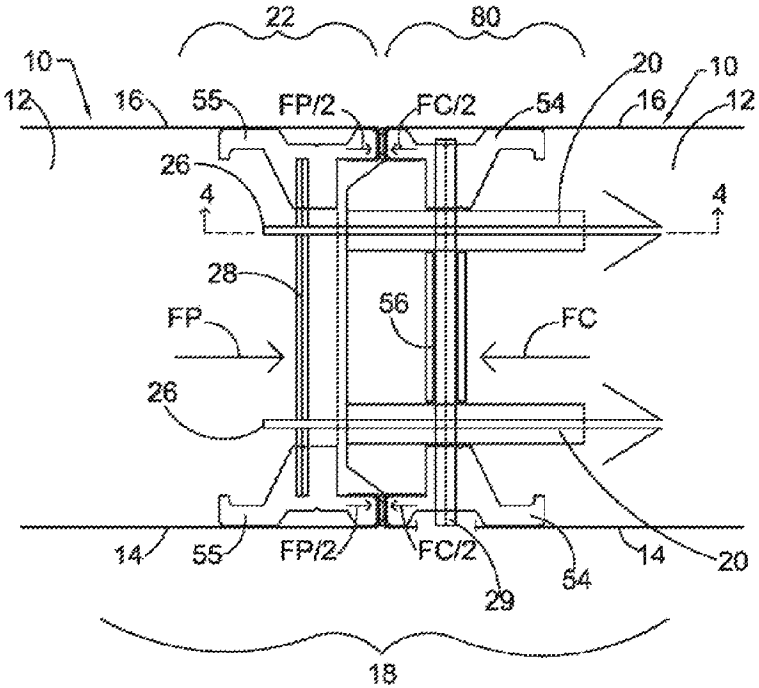
FIG. 6 is a view taken along line 6-6 of FIG. 1.
Figure 7:
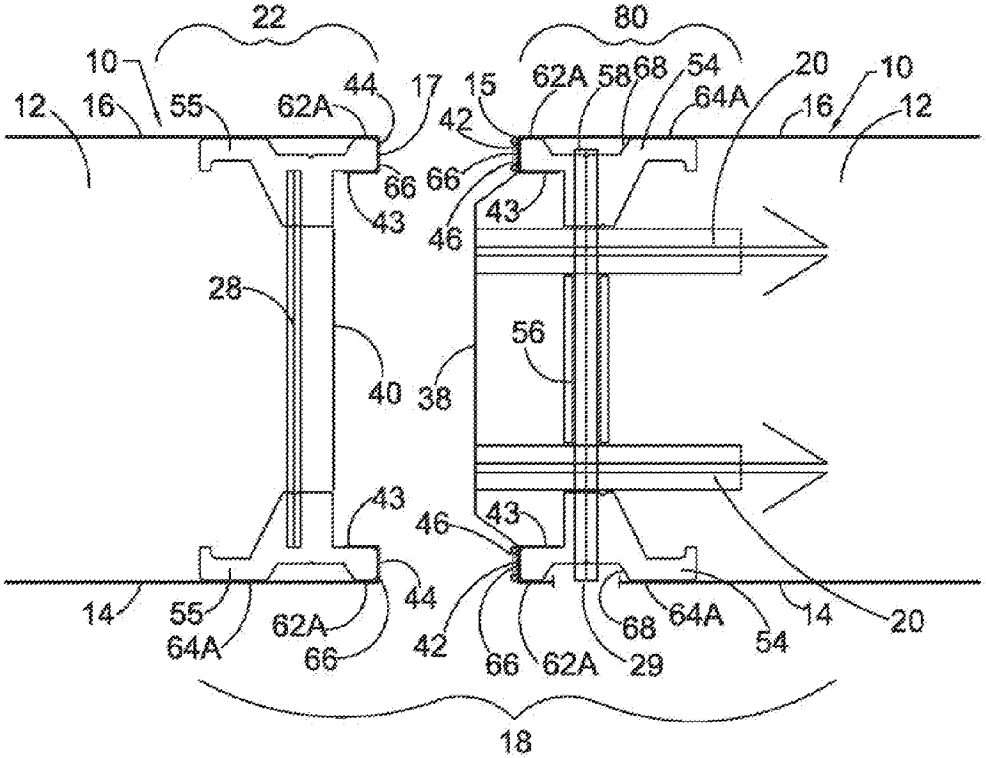
FIG. 7 is a view similar to FIG. 6, but with the insulated panels still apart from each other, before they have been latched together.
Figure 8:
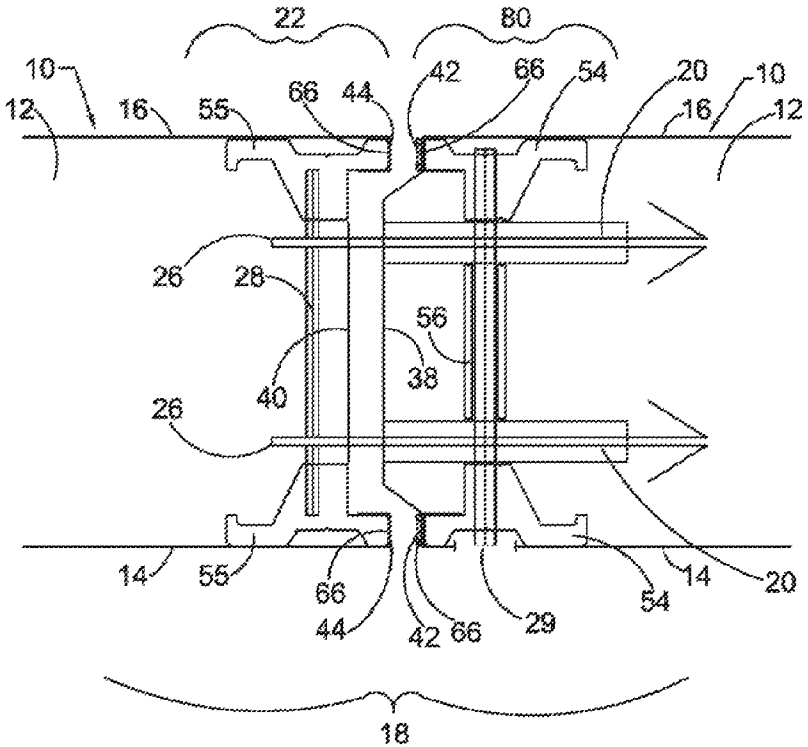
FIG. 8 is a view similar to FIG. 6, but with the hooks engaging the pin, before the panels are snugged up tightly together.
Figure 13:
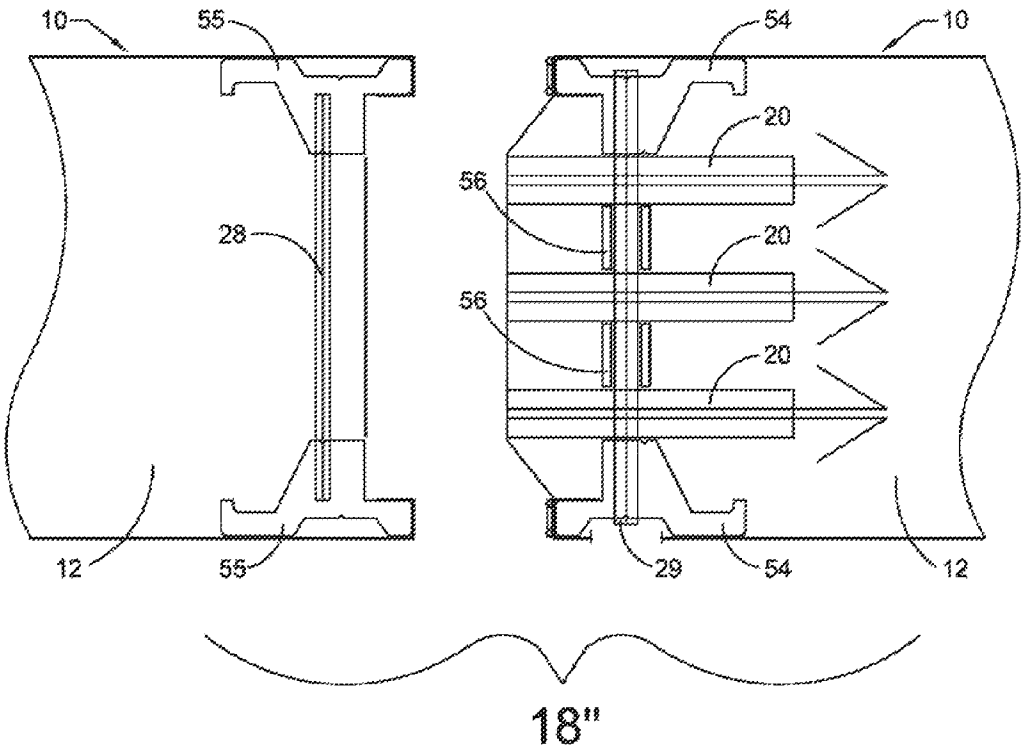
FIG. 13 is a side view, similar to FIG. 7, but for another embodiment of a latching arrangement.

FIGS. 6-8 show the latching arrangement 18 in more detail. In this particular embodiment, there are two hook assemblies 20 engaging a single pin assembly 22. However, as shown in FIG. 13 and explained in more detail later, the number of hook assemblies 20 may vary from a single hook assembly 20 to three or more hook assemblies 20. The number of pin assemblies 22 also may vary, as shown for a different embodiment in FIG. 10.

Referring now to FIG. 6, the latching arrangement 18 includes two hook assemblies 20, each of which is substantially identical to the hook assembly 20P of FIG. 5. A hexagonal cross-section rod 29 extends between the hook assemblies 20 and connects them together. The pin assembly 22 uses a single pin 28 extending substantially the full thickness of the insulated panel 10. The latching arrangement 18 also includes two rod support members 54, two pin support members 55, and a spacer 56, as described in more detail below.

Figure 15:
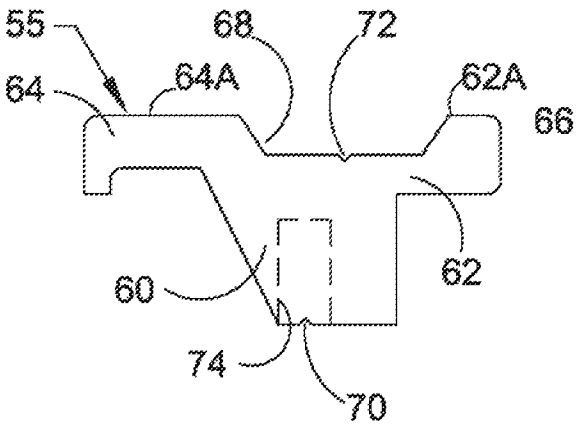
FIG. 15 is a side view of the rod support member of FIGS. 6-8.

FIG. 15 is a side view of one of the pin support members 55 of FIGS. 6-8. (This pin support member 55 is identical to the rod support member 54 of FIG. 9, except for the location of the holes 76, 74 respectively, as described in more detail later) The pin support member 55 has a generally T-shaped cross-section, with three legs 60, 62, 64. The first leg 62 and second leg 64 have planar skin abutment surfaces 62A, 64A, respectively, which, when installed, lie flat along the interior surface of their respective planar skin 14, 16. The first leg 62 has an end surface 66, which is at right angles to the planar skin abutment surface 62A. As shown in FIG. 7, this end surface 66 abuts and bears against the interior surface of one of the end faces 44 of the skin of the insulated panel 10. (Similarly, the end surface 66 of the rod support member 54 abuts and bears against the interior surface of one of the end faces 42 of the skin of the insulated panel 10.) A concave recessed surface 68 is located opposite the leg 60. Small V-notches 70, 72 on the leg 60 and on the concave recessed surface 68, respectively, mark the spot for drilling holes into or through the leg 60, as required, to receive the pin 28 or the hex rod 29, as described later.

The pin support member 55 (and the rod support member 54) may be made in any of a number of known ways, such as an extrusion, preferably made of extruded aluminum, or a casting, preferably made of metal, or even a bent steel piece. The length of the support members 54, 55 (extending in a direction perpendicular to the page in FIGS. 9 and 15 and in the vertical direction in FIG. 4) may vary depending on the application, but the length typically ranges from 6 inches to 18 inches. As may be appreciated from FIG. 6, the support member 54, 55 is a universal piece which is flipped about its axis for use on opposite walls 14, 16 and on opposite sides of the insulated panel 10.

Figure 9:
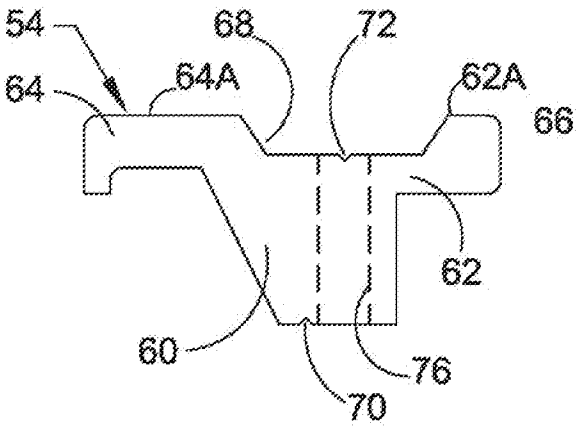
FIG. 9 is a side view of the rod support member of FIGS. 6-8.

FIG. 15 shows in dotted lines a drilled hole 74 aligned with the V-notch 70 for receiving the pin 28. FIG. 9 shows in dotted lines a drilled hole 76 aligned with the V-notch 72 for receiving the rod 29. These holes 74, 76 may be drilled depending on the application, such that only the support members 55 to be used to receive the pin 28 are drilled with the hole 74, and only the support members 54 to be used to receive the hex rod 29 are drilled with the hole 76. The hole 76 in the rod support member 54 is drilled completely through the rod support member 54 on at least one side of the panel 10, so a hex wrench can access the rod 29 to rotate the rod 26 and the hooks 26 that are mounted on the rod 29.

To assemble the latching arrangement 18, the ends of a pin 28 are inserted into the holes 74 of two opposite pin support members 55, and this pin assembly 22 is pushed into the mold (prior to blowing in the foam insulation 12) such that the end surfaces 66 of the support members 55 are abutting the interior surfaces of their respective end faces 44 of their inner and outer skins 14, 16. Likewise, two hook assemblies 20 are mounted on a common hex rod 29 which extends through the openings 76 of two rod support members 54, with a spacer 56 extending between the two adjacent hook assemblies 20, and this complete assembly 80 is pushed into the mold (prior to blowing in the foam insulation 12) such that the end surfaces 66 of the rod support members 54 abut the interior surfaces of the end faces 42 of the inner and outer skins 14, 16. The hex rod 29 projects into the cavity formed by the concave recess 68 to allow a user to use a socket head wrench to rotate the rod 29, which rotates both of the hook assemblies 20 to engage with or disengage from the pin 28 of the adjacent panel 10. The spacer 56 is a hollow cylinder mounted concentrically with and surrounding the hex rod 29.

The pin 28 has an inner end portion adjacent to the inner skin 14, an outer end portion adjacent the outer skin 16, with the pin 28 lying between and extending perpendicular to the inner and outer planar skins 14, 16. The inner pin support member 55 has surfaces 62A, 64A that abut the interior surface of the inner skin 14, and the outer pin support member 55 has surfaces 62A, 64A that abut the interior surface of the outer skin 16.

The rod 29 has an inner end portion adjacent to the inner skin 14 and an outer end portion adjacent to the outer skin 16, with the rod 29 lying between and extending perpendicular to the inner and outer planar skins 14, 16. The inner rod support member 54 has surfaces 62A, 64A that abut the interior surface of the inner skin 14, and the outer rod support member 54 has surfaces 62A, 64A that abut the interior surface of the outer skin 16.

An insulated panel 10 will typically have hook assemblies 20 along two adjacent ends of the insulated panel 10 (typically in the tongue portions of the tongue and groove profiles of the insulated panel 10), and pin assemblies 22 along the other two ends of the insulated panel 10 (typically in the groove portions of the tongue and groove profiles of the insulated panel 10), as shown in FIGS. 1-3. Once the hook assemblies 20 and the pin assemblies 22 have been installed into a mold in the desired locations along the ends of the insulated panel 10, the foam insulation 12 may be blown in to fill the space between the walls 14, 16, including the area surrounding the hook assemblies 20 and the pin assemblies 22. If no measure has been taken to prevent the foam insulation 12 from covering up the portions of the pin 28 which engage the hooks 26 of the hook assemblies 20, it may be necessary to cut out and remove small channels (not shown) of the foam insulation 12 to provide such access.

The assembly of adjacent insulated panels 10 is shown in FIGS. 6-8. First, the insulated panels 10 are brought together such that the tongue portion 38 of one insulated panel 10 is lined up with the groove portion 40 of the adjacent insulated panel 10, as shown in FIG. 7. In this configuration, the hook assemblies of the first panel 10 line up with the pin assembly 22 of the adjacent panel 10.

The installer then brings the two panels closer together, as shown in FIG. 8, and uses a socket head wrench (not shown) to engage one end of the hex rod 29 and rotates the hex rod 29 which also rotates the hooks 26 of the hook assemblies 20 to a first position wherein the hooks 26 engage the pin 28 of the pin assembly 22. Further rotation of the hex rod 29 results in a cam action which retracts the hooks 26 back into their respective panel 10, as shown in FIG. 6. This brings the adjacent ends of the two adjacent panels 10 snugly together.

As shown in FIG. 6, this final tightening action results in the following load forces:

a) The force Fp resulting from the hooks 26 of the hook assemblies 20 pulling on the pin 28. This force Fp is transmitted to the pin support members 55 by the pin 28, and is in turn transmitted to the end faces 44 (See FIG. 8) of the inner and outer skins 14, 16 of one of the insulated panels 10 as forces Fp/2.

b) An equal magnitude, opposing force Fc on the rod 29 resulting from the resistance by the pin 28. This force Fc is transmitted to the rod support members 54 by the hex rod 29, and is in turn transmitted to the end faces 42 (see FIG. 8) of the inner and outer skins 14, 16 of the other insulated panel 10 as forces Fc/2.

It should be pointed out that these pairs of opposing forces Fp/2, Fc/2 are substantially of the same magnitude but acting directly against each other, as shown also in FIG. 4. Furthermore, the full magnitude of these opposing forces Fp/2, Fc/2 only comes into play when the end faces 42, 44 of the adjacent panels 10 are abutting each other, as shown in FIGS. 4 and 8. Since the forces Fp/2, Fc/2 are of the same magnitude but act in opposite directions on their corresponding end faces 42, 44, and since these corresponding end faces 42, 44 abut each other when the panels 10 are snugged up tightly against each other, these forces Fp/2, Fc/2 cancel each other out and do not act to deform the skins 14, 16. Finally, even if the foam insulation 12 in the insulated panels 10 deteriorates or breaks down, this latching arrangement 18, being substantially independent of the foam insulation 12, does not shift relative to the panels 10, so the panels 10 remain snugly engaged with each other.

It should be noted that it is not necessary for the full lengths of the end faces 66 of the opposing support members 54, 55 to be exactly coextensive with each other. However, it is desirable for at least a portion of one of the end faces 66 of one support member to lie directly opposite the end face 66 of the opposing support member and even more desirable for a large portion of the opposing end faces 66 to lie directly opposite each other in order to prevent deformation of the skins 14, 16.

Figure 10:
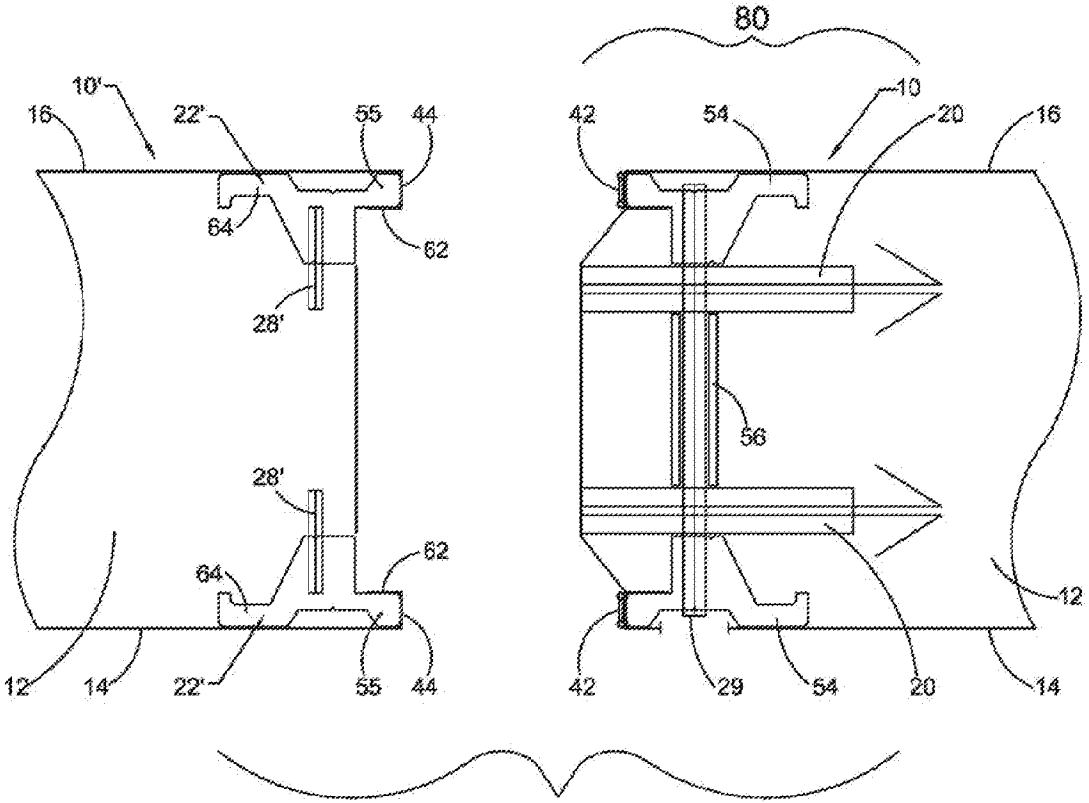
FIG. 10 is a side view, similar to FIG. 7, but for another embodiment of a latching arrangement.

FIG. 10 shows a second embodiment of a latching arrangement 18'. Comparing FIG. 10 with the embodiment of FIG. 7, it is readily apparent that the only substantial difference is the fact that this embodiment has two separate pins 28' which extend only a short distance into the panel 10' instead of a single, longer pin 28 which extends substantially the full width of the panel. In this embodiment, each pin assembly 22' individually transfers the clamping load of the opposite hook assembly 20 to its corresponding support member 55, which in turn transfers its load to its corresponding end face 44. In this case, there will be a bit of a cantilevered load on the pin 28', tending to cause the leg 64 of the pin support member 55 to want to rotate toward the interior about the leg 62. However, the opposing force from the foam 12 prevents any rotation, and the main force is still transmitted to the end face 44 as in the previous embodiment. Other than this structural difference, the latching arrangement 18' operates in substantially the same manner as the latching arrangement 18 described above.

Figure 11:
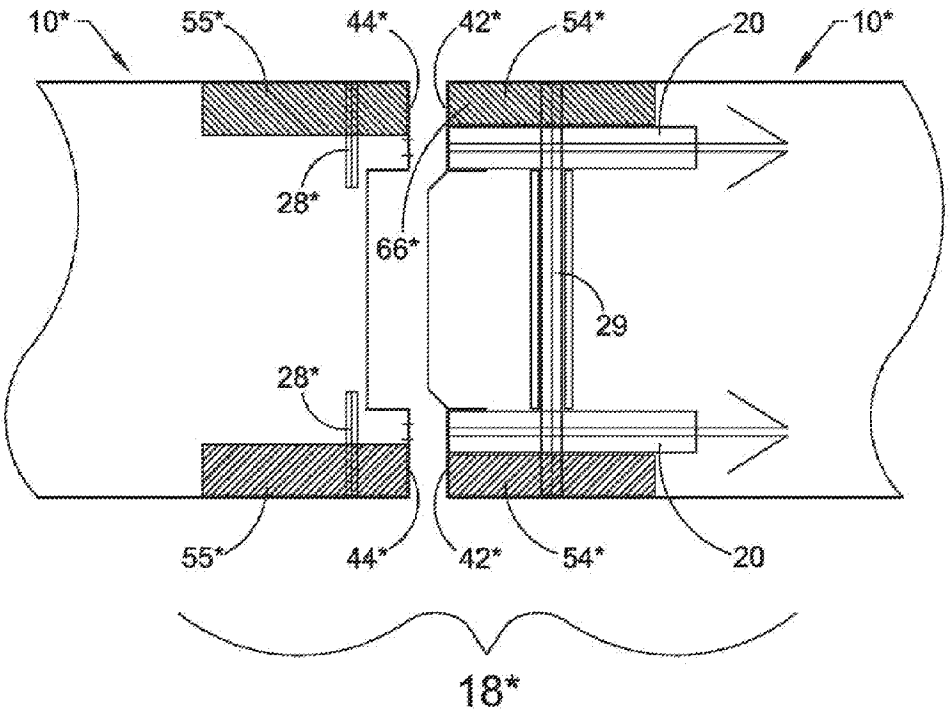
FIG. 11 is a side view, similar to FIG. 10, but for another embodiment of a latching arrangement.

FIG. 11 shows another embodiment of a latching arrangement 18*. In this instance, the T-shaped support members 54, 55 have been replaced with rectangular support members 54*, 55* which serve substantially the same function, that is, to transfer the clamping loads to the end faces 42*, 44*. In this case, the end faces 42*, 44* are deeper such that the end surfaces 66* of the support members 54* fit against the end faces 42* along with the ends of the hook assemblies 20, so both the support members 54* and the hook assemblies 20 apply force to the end faces 42*.

While FIG. 11 shows an embodiment in which there are two pins 28*, similar to the arrangement of FIG. 10, it should be clear that a single pin arrangement, similar to that of FIG. 6, may be substituted for the two pins 28*. The latching arrangement 18* works in substantially the same manner as the latching arrangement 18 described earlier.

Figure 12:
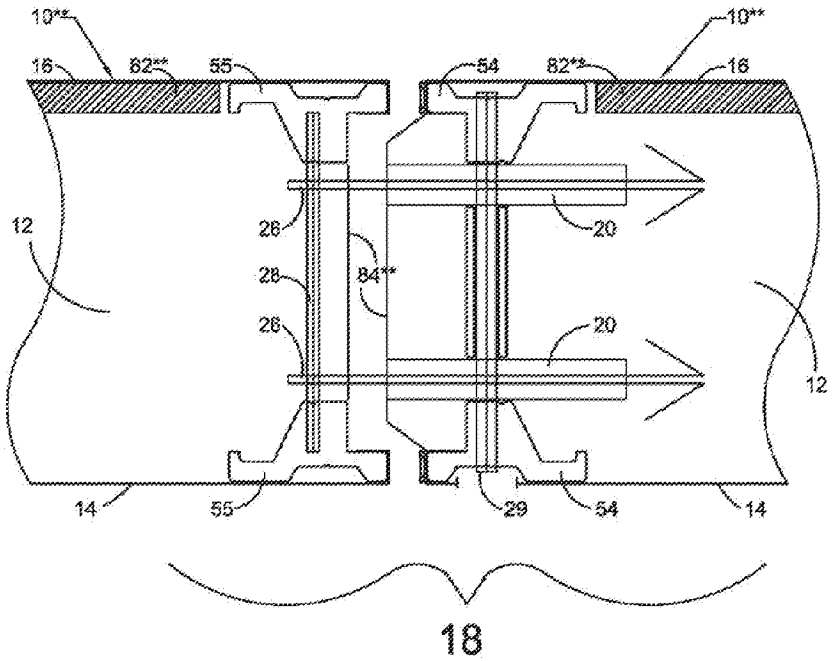
FIG. 12 is a side view, similar to FIG. 8, but for another embodiment of an insulated panel made in accordance with the present invention.

FIG. 12 shows another embodiment of an insulated panel 10. Comparing this insulated panel 10** with the insulated panel 10 of FIG. 8, it may be appreciated that the latching arrangement 18 remains unchanged. The main difference here is that substantially all of the interior surface of the outer skin 16 has been lined with a high temperature insulating barrier 82** to further protect the foam insulation 12 from temperature extremes. Various high temperature barrier materials could be used for the liner 82**, such as Fiberfrax by Unifrax LLC from Niagara Falls, N.Y. This insulating liner 82** may be placed on the interior surface of either or both of the skins 14, 16 of the insulated panel 10****.

In this embodiment, a high temperature moisture barrier 84 has been applied to all the exposed ends of the foam insulation 12. The high temperature moisture barrier 84** prevents moisture migration into the foam insulation 12 to protect the foam insulation 12, even in high humidity and high temperature applications. The moisture barrier 84**** may be a silicone coating, a moisture proof tape such as aluminum duct tape, a combination of a silicone coating and tape, or other moisture resistant materials.

FIG. 13 shows another embodiment of a latching arrangement 18". A comparison with the embodiment of FIG. 6 shows that this latching arrangement is substantially identical except for the use of a third hook assembly 20 and the use of two shorter spacers 56" between adjacent hook assemblies 20. Other than this structural difference, this embodiment operates in the same manner as the latching arrangement of FIG. 6.

Figure 14:
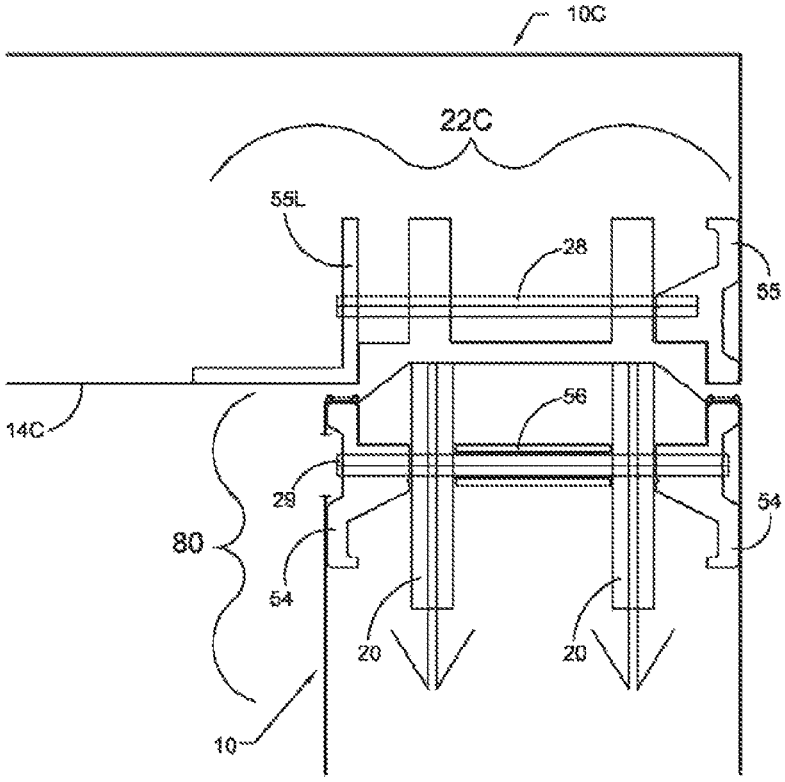
FIG. 14 is a side view, similar to FIG. 7, but for another embodiment of a latching arrangement involving a wall panel and a ceiling panel.

FIG. 14 shows one more embodiment of a latching arrangement which may be used to connect a regular wall panel 10 to a ceiling panel 10C (which may also be a floor panel). The hook arrangement 80 is identical to the hook arrangement 80 of FIG. 8. The pin assembly 22C is similar to the pin assembly 22 of FIG. 8, except that the leftmost pin support member 55L is an angle iron which serves the same purpose as the support member 55, of transferring the force from the pin 28 to the skin 14C but is better suited to the physical configuration of the ceiling or floor panel. Other than this structural difference, this embodiment operates in the same manner as the latching arrangement 18 of FIG. 8.

Figure 16:
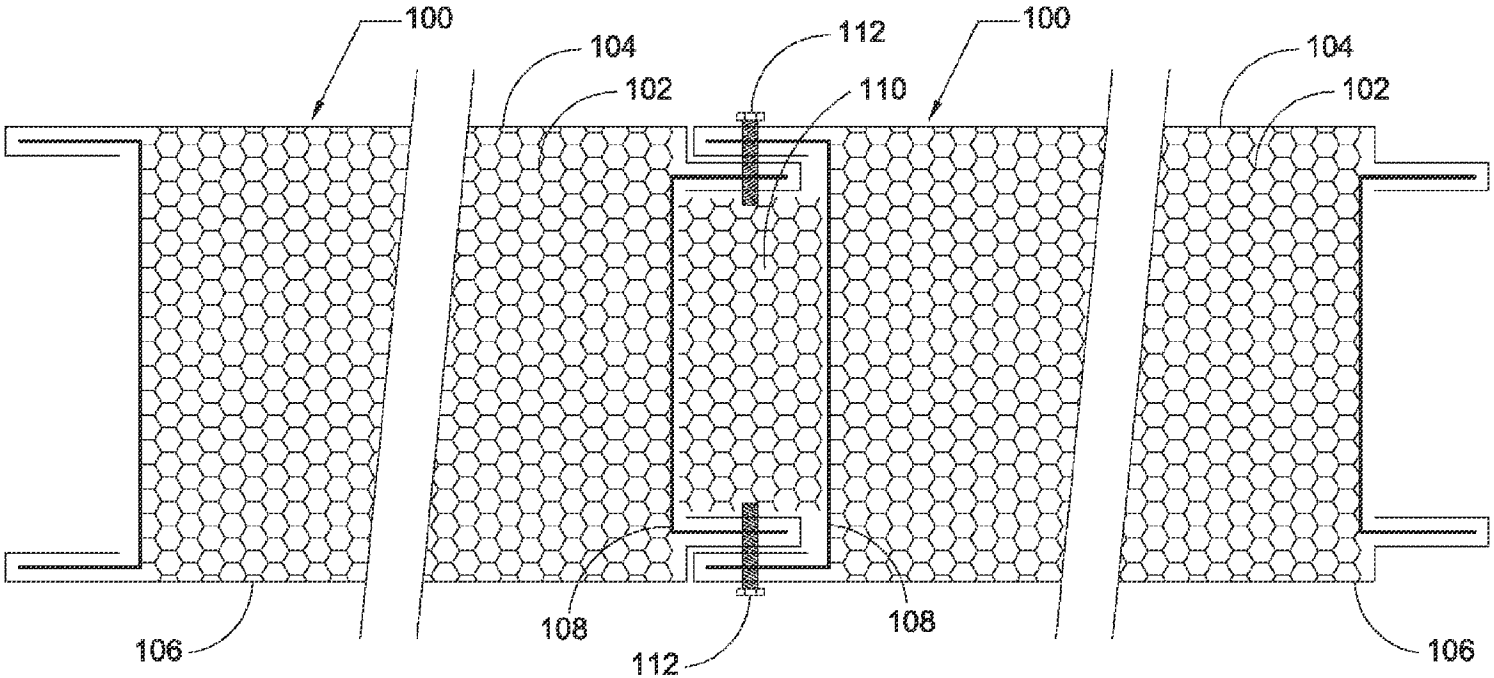
PRIOR ART FIGURE 16
FIG. 16 is a view similar to that of FIG. 6, but for a prior art latching arrangement for use in very high temperature panels.
Figure 17:
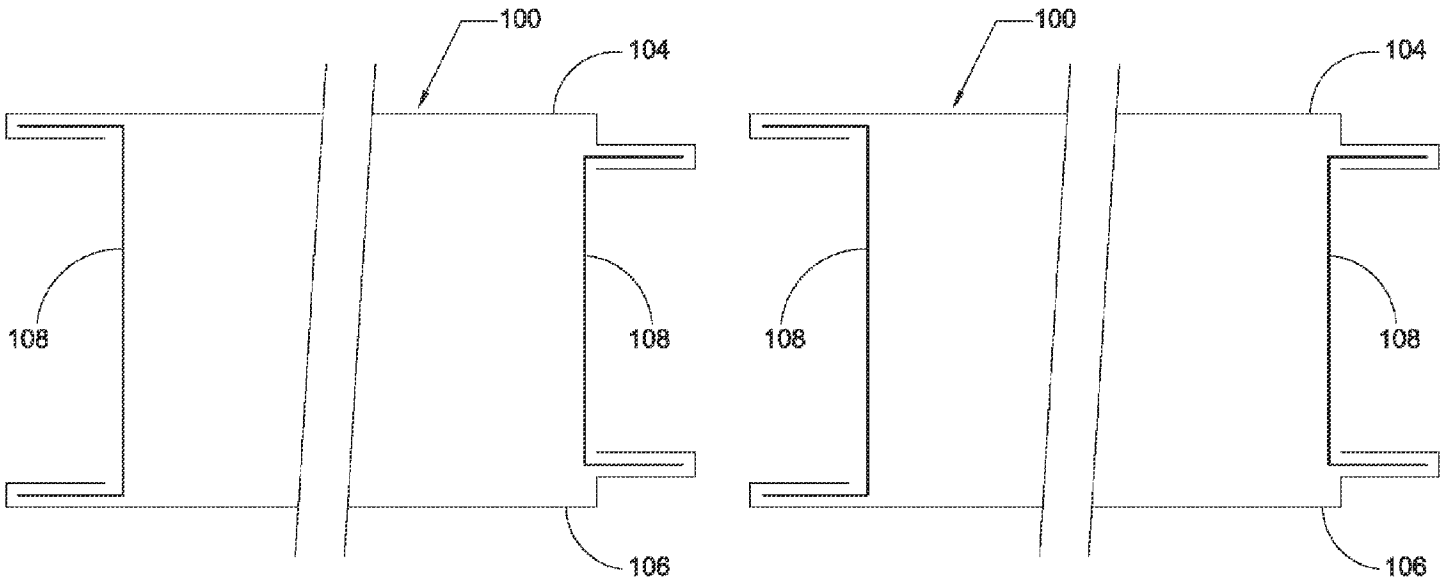
PRIOR ART FIGURE 17
FIG. 17 is a view similar to that of FIG. 16, showing the prior art panels before they are snugged up together, but with the mineral wool insulation omitted for clarity.

FIGS. 16 and 17 are section views showing two prior art panels 100 used in very high temperature applications, such as in walk-in oven chambers. These panels 100 are filled with mineral wool insulation 102 because the more conventional urethane foam insulation discussed earlier cannot withstand the high temperatures encountered in this type of application. However, since mineral wool insulation 102 is not weight-bearing, it cannot be relied upon for structural support. As is better appreciated in FIG. 17, the panels 100 include "C" channel members 108 extending substantially the full length (height) of the panel 100 along both the left and the right ends of the panel 100 between the inner skin 104 and the outer skin 106.

During assembly, these panels 100 are brought together so that their corresponding "C" channel members 108 interlock with each other, as shown in FIG. 16. The space between these "C" channel members 108 is filled with mineral wool insulation 110 during this assembly process, and then the panels 100 are screwed together with self-tapping zip screws 112, as shown in FIG. 16. This assembly process is time-consuming and tedious. It is next to impossible to check whether the installer forgot to place the mineral wool insulation 110 in the space between the "C" channel members 108 until after start-up, when the problem manifests itself in higher than expected temperatures on the cold side 106 at the connection of the panels 100. The "C" channel members 108 also provide a large contact area which results in undesirable heat transfer from the hot side 104 to the cold side 106 of the panels 100.

Referring to FIGS. 18-21, the high temperature panels 115 made in accordance with an embodiment of the present invention include inner and outer skins 104', 106'.

Figure 20:
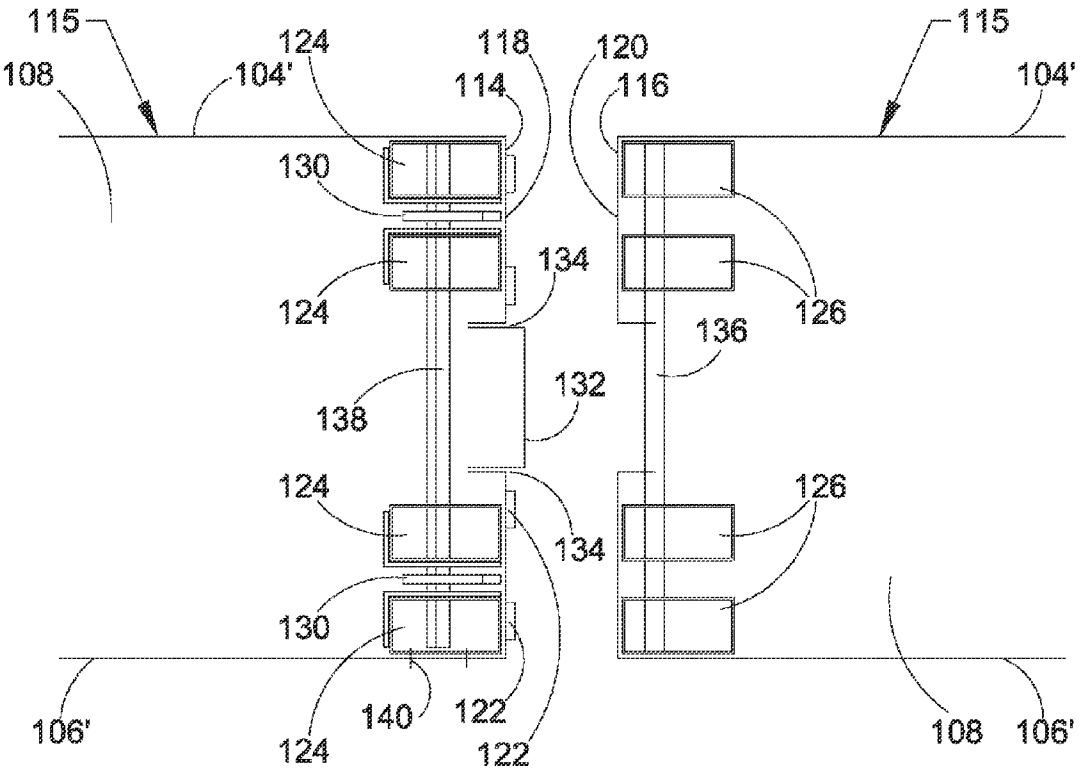
FIG. 20 is a view along line 20-20 of FIG. 19, but showing also a mating panel, similar to the view of the latching arrangement of FIG. 11.

Referring to FIG. 20, the left and right opposed edges 114, 116 of each of the inner and outer skins 104', 106' are bent toward the other of the skins 106', 104', respectively, to form left and right opposed end faces 118, 120. (The top and bottom edges also are bent inwardly in the same manner.) Gaskets 122 are installed on at least one of these left and right opposed end faces 118, 120 to aid in sealing the panels 115 against each other. Mineral wool insulation is placed in the space 108 between the inner and outer skins 104', 106'.

Rod support members 124 and pin support members 126, similar to the rod support members 54* and pin support members 55* of FIG. 11, are placed inside the opposing faces 118, 120 respectively of the panels 115. These support members 124, 126 are secured to the inside of the opposing faces 118, 120 by suitable means, such as by an adhesive or by welding. As shown in FIG. 20, each rod support member 124 is directly opposite a respective pin support member 126, and each hook 130 is directly opposite an opening to the pin 136. The rod 138 has a hexagonal shape, and, when it is rotated, it rotates both hooks 130.

Figure 21:
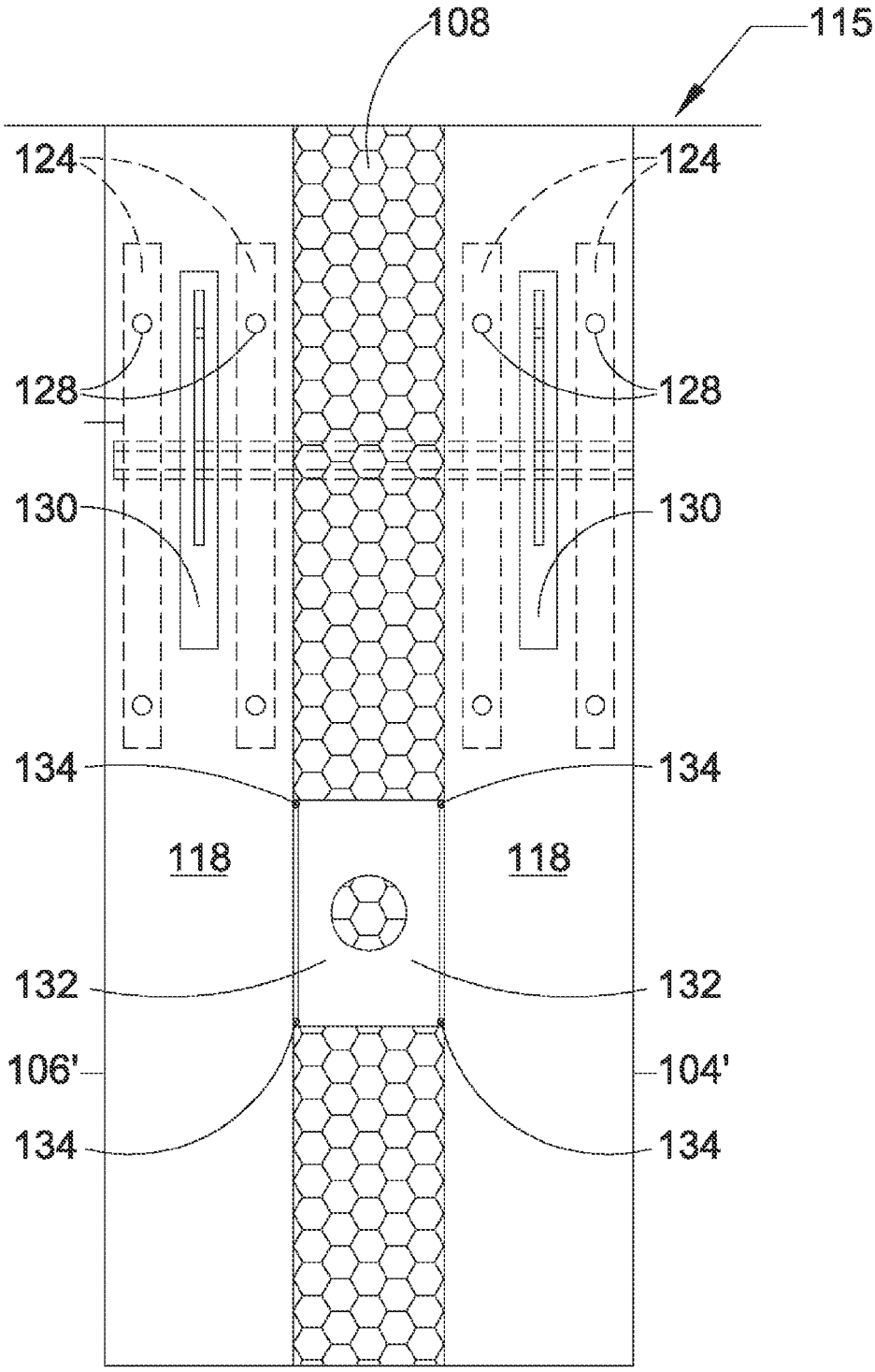
FIG. 21 is a view along line 21-21 of FIG. 18.

FIG. 21 shows a detail of the installation of the rod support members 124 when welding is chosen as a securing option. Through openings 128 are drilled or punched through the face 118 of the inner and outer skins 104', 106' at the desired height of the support members 124. The support members 124 are then placed inside the face 118 and the support members 124 are tack welded to the face 118 through the openings 128. It should be noted that the pin support members 126 are mounted in a similar manner to the inside of their respective face 120.

As shown in FIGS. 20 and 21, each of the end faces 118 extends from its respective inner or outer planar skin 104' or 106' toward the other planar skin 106' or 104' and extends beyond one of the hook assemblies 130 and beyond the two rod support members 124 for that respective hook assembly 130, terminating at a peripheral edge 107 or 109. The peripheral edges 107, 109 are spaced apart from each other, with the spacers 132 maintaining a fixed spacing between the peripheral edges 107, 109. The two rod support members 124 for each hook assembly 130 are located on the inner and outer sides of the respective hook assembly 130, with both of the rod support members 124 for each hook assembly 130 bearing against the same end face 118 of the same planar skin 104' or 106'. (to clarify, the hook assembly 130 closest to the inner planar skin 104' is supported by two rod support members 124 (the outer rod support member bearing against the end face 118 of the inner planar skin 104' and the inner rod support member also bearing against the end face 118 of the inner planar skin 104'). Likewise, the hook assembly 130 closest to the outer planar skin 106' is supported by two rod support members 124 (the outer rod support member bearing against the end face of the outer planar skin 106' and the inner rod support member also bearing against the end face of the outer planar skin 106'). In addition to the through openings 128 that are used for tack welding the support members 124 to their respective skin 104', 106', each of the end faces 118 also defines a slotted through opening aligned with its respective hook 26 to provide a space that permits the respective hook 26 to extend through the end face 118 of the respective planar skin 104' or 106' to reach the pin 28 of the next panel.

A pin support member 126 is located opposite each of the rod support members 124, with two pin support members 126 for the pin 136 bearing against the second end face 120 of the inner planar skin 104' and two pin support members 126 for the pin 136 bearing against the second end face 120 of the outer planar skin 106'.

As was mentioned earlier, the mineral wool insulation 108 is not weight-bearing, so it cannot be relied upon to maintain the inner and outer skins 104', 106' in spaced apart relationship to each other. On the end 114 of the panel 115, which has the rod support members 124 (which rotationally support the hook assemblies 130 (See also FIG. 18)), "C" shaped spacers 132 are placed at regular intervals along the length of the panel 115 to keep the inner and outer skins 104', 106' in a uniform, spaced apart relationship. These spacers 132 are very short relative to the overall length of the panel 115. In one embodiment, the spacers 132 are tack welded at their four corners 134 (See also FIG. 21) to the faces 118 of the inner and outer skins 104', 106'. Since the spacers 132 contact such a small surface area of the skins 104', 106', this results in a very small surface area available for heat transfer from the hot, inner skin 104' to the cold, outer skin 106'.

At the other end 116 of the panel 115, the pin 136, supported by the pin support members 126, functions as a spacer to keep the inner and outer skins 104', 106' in spaced apart relationship. The ends of the pin 136 contact the inside of the inner and outer skins 104', 106' to keep these skins in a uniform, spaced apart relationship.

Note that the spacers 132 are used on the end 114 of the panel 115 which has the rod support members 124 because at least one end of the rod 138, which is rotationally supported by the support members 124, is exposed through an opening 140 (See FIG. 20) to allow the user access to rotate the hook assemblies 130 during the assembly or disassembly process, as described earlier with respect to previous embodiments, and therefore cannot be used to hold the skins apart in the same manner as the pins 136.

Figures 18, 19:
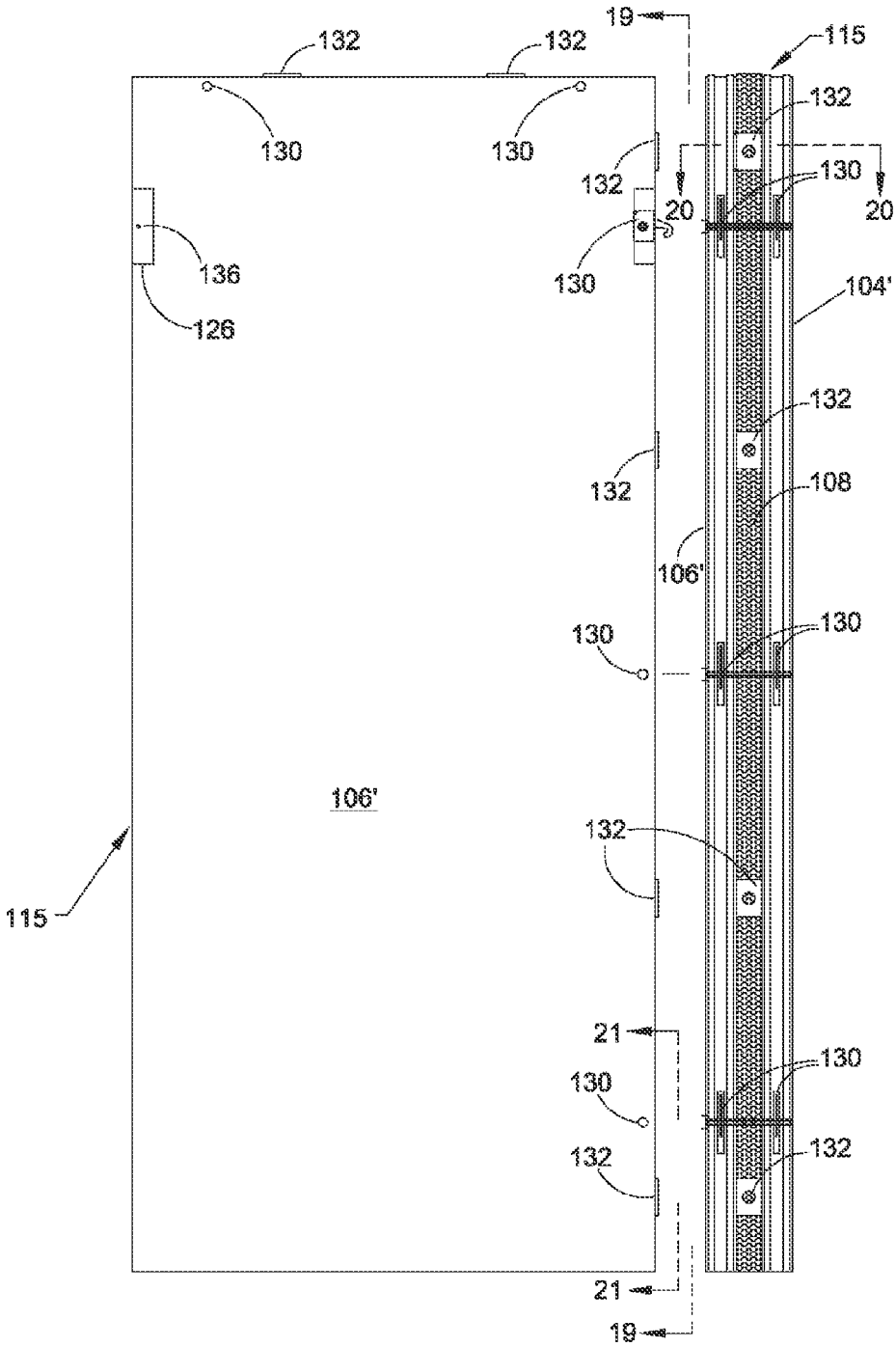
FIG. 18 is a side view of an insulated panel made in accordance with the present invention, with the panel partially broken away to show one of the latch mechanisms.
FIG. 19 is a view along line 19-19 of FIG. 18.

Referring to FIG. 18, it may be appreciated that two ends of the panel 115 (in this instance the top and right ends) include the hook assemblies 130, and therefore use spacers 132 to maintain the inner and outer skins 104', 106' in spaced apart relationship. The other two ends (in this instance the bottom and the left ends) include the pins 136 and the pin support members 126, with the pins 136 also serving as spacers to maintain the inner and outer skins 104', 106' in spaced apart relationship. Other than these structural differences, this embodiment operates in the same manner as the latching arrangement 18* of FIG. 11.

High Temperature Panels with Weldable Skins

Figure 22:
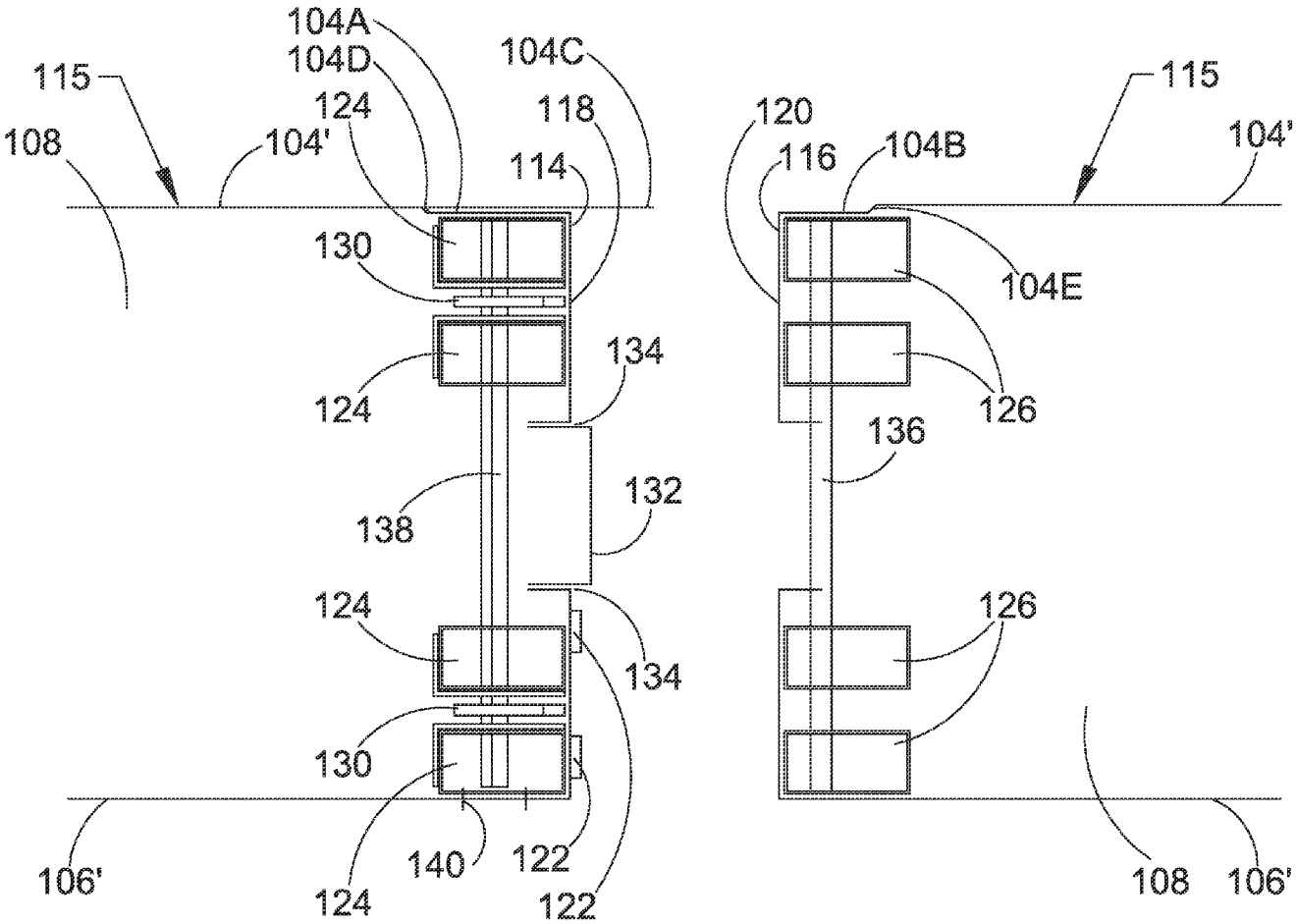
FIG. 22 is the same view as FIG. 20 but for a modified version of the panel suitable for welding the skins together.
Figure 23:
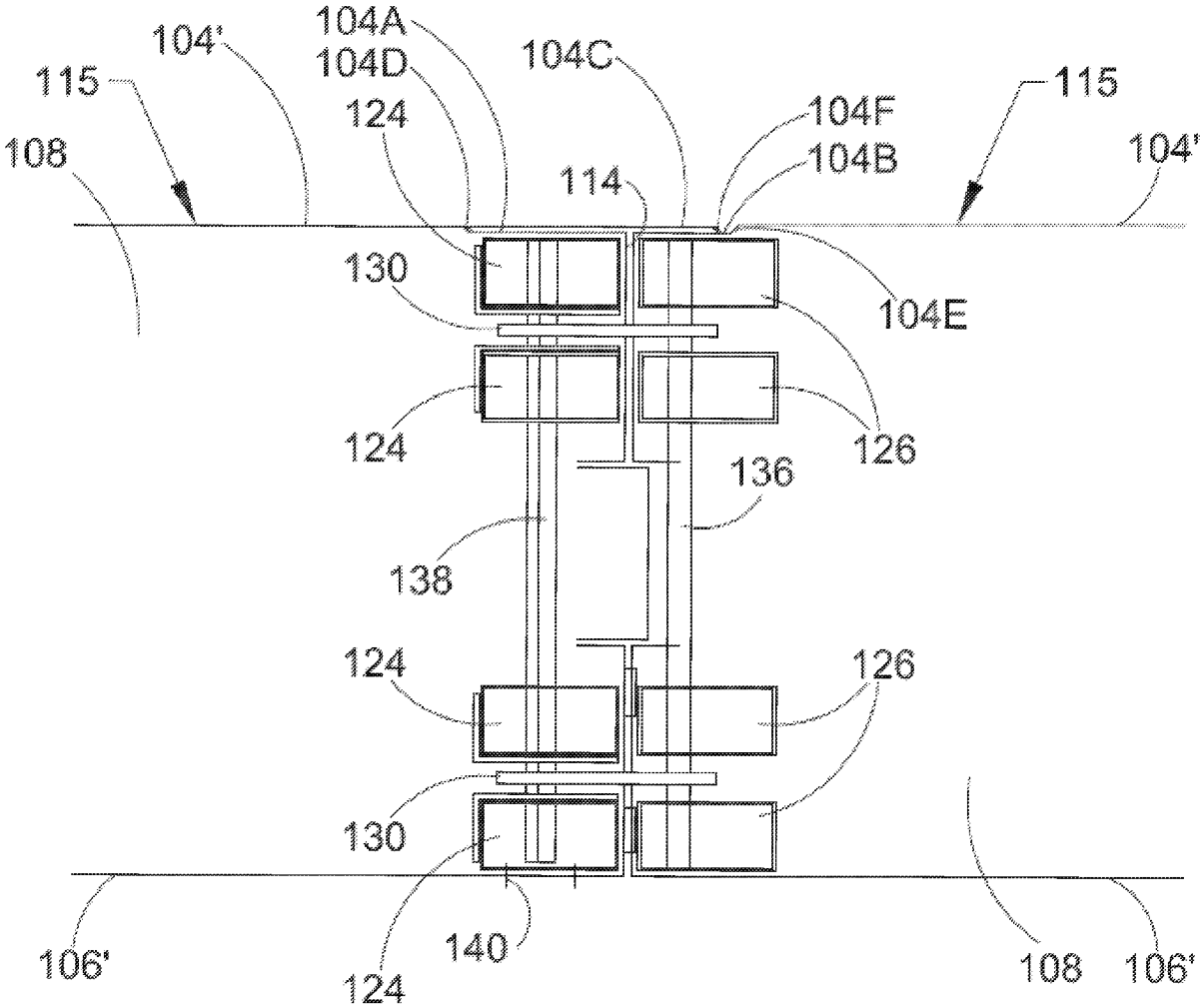
FIG. 23 is the same view as FIG. 22 but with the panels joined and the skins welded together.
Figure 24:
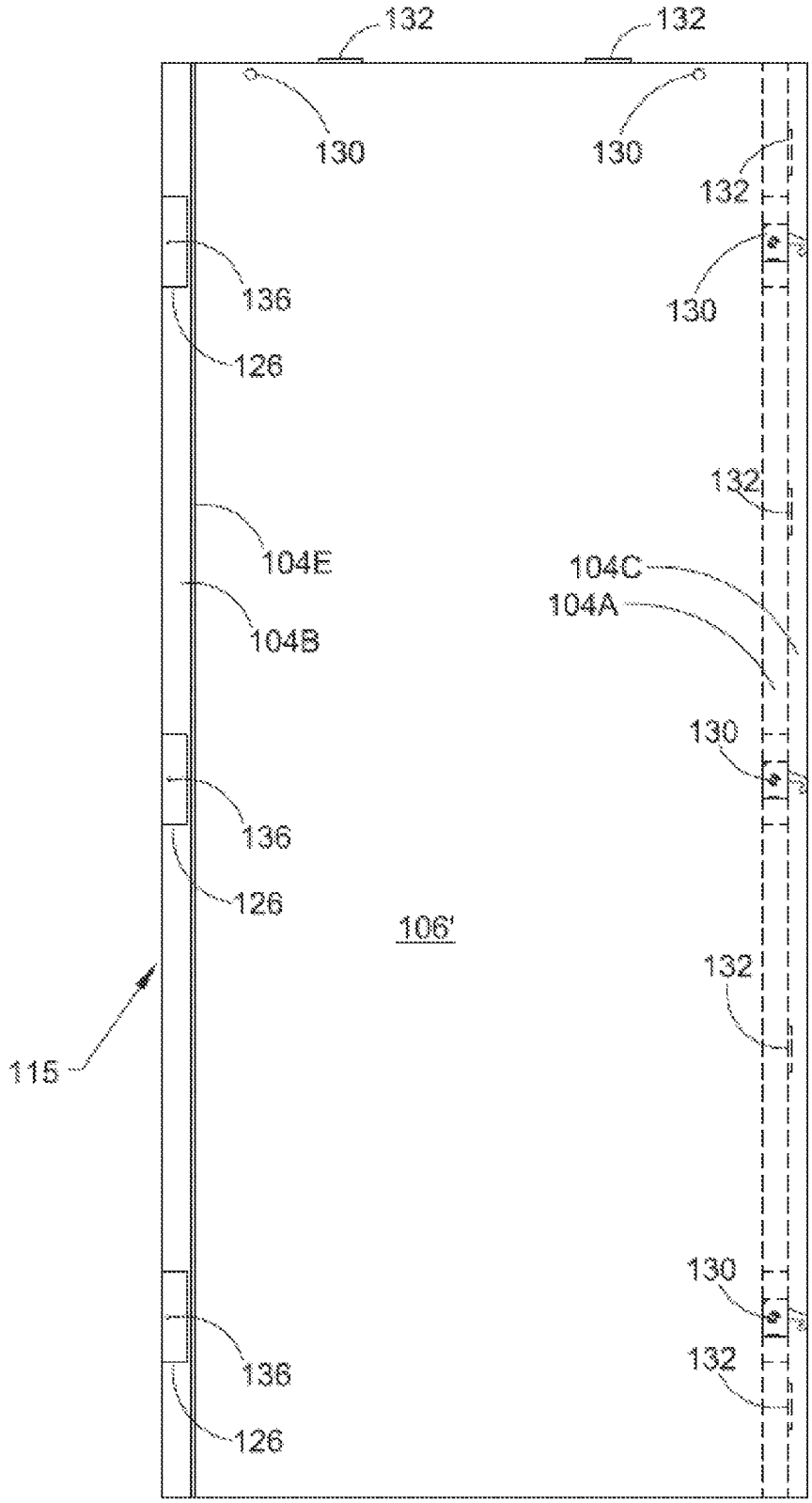
FIG. 24 is a side view of the panel of FIGS. 22 and 23.

In some applications it is desirable to have smooth, sealed walls to prevent gases from escaping, for instance, or to allow the enclosed chamber to be washed down with sprayed water or cleaning chemicals, such as are used during CIP (Clean-in-Place). FIGS. 22-24 show an alternative embodiment that is the same as the embodiment of FIGS. 18-21 except that it has been modified to permit the skins of adjacent panels to be welded together after the panels are assembled and latched together. (The end view of this alternative panel is the same as FIG. 19.) This allows easy and inexpensive shipping of individual, high-temperature panels to the job site, followed by seal welding once the panels are assembled to provide the smooth, sealed surfaces.

The modification includes extending the straight portion of the skin 104' on the hook end beyond the end face 118 to form an extension 104C along the full height of the panel. An additional piece of the sheet material from which the skin is made is welded to the inside of the straight portion of the skin 104' along a weld line 104D that extends along the full height of the panel and is bent to form the end face 118 prior to inserting the insulation between the skins 104', 106'. On the pin side of the skin 104', the skin is indented along a shoulder 104E to form a recessed portion 104B along the full height of the panel, which permits the extension 104C from the adjacent panel to be received in the recessed portion 104B.

As shown in FIG. 23, when the panels are brought together and the hooks 130 are hooked onto the respective pins 136, locking the panels snugly together, the extension 104C is received in the recess 1048, with the edge of the extension 104C lying adjacent to the shoulder 104E. The edge of the extension 104C is welded to the next adjacent panel along a weld line 104F that extends the full height of the panel along the shoulder 104E, and then the weld is ground down so the resulting structure has a smooth, flat, continuous skin 104' extending along both of the adjacent panels. Of course, this can be repeated, using as many panels as desired to form the final structure. This modification also can be made along the top and bottom edges of the panels, if desired.

In order to permit welding the panels together, which typically involves high temperatures, an insulation material is used that can withstand the high temperatures of the welding, such as a mineral wool, for example, at least in the area adjacent to the weld 104F.

While this embodiment shows the recess, straight extension, and welding only on one (inner or outer) skin 104', this arrangement could be provided only on the other of the inner and outer skins 106' or on both the inner and outer skins 104', 106', as desired. Also, as another alternative, the extension could be on the pin side of the panel and the recess could be on the hook side of the panel, if desired.

The embodiments described above show several latching arrangements for use with insulated panels. It will be obvious to those skilled in the art that modifications may be made to the embodiments described above without departing from the scope of the invention as claimed.

What is claimed is:

1. An insulated panel arrangement, comprising:

an insulated panel having a pair of opposed left and right panel ends and a pair of opposed top and bottom panel ends, said insulated panel including parallel, spaced-apart inner and outer planar skins defining an interior space between said inner and outer planar skins, and an insulated core extending between said inner and outer planar skins and generally filling said interior space;

wherein each of said planar skins has a pair of opposed top and bottom edges and a pair of opposed left and right edges, with at least one pair of opposed edges on each of said planar skins being bent toward the other of said planar skins to define two pairs of first and second opposed end faces located at respective first and second opposed panel ends;

a hook assembly at the first of said respective opposed panel ends; and a pin assembly at the second of said respective opposed panel ends, directly opposite the hook assembly so that, when two of said insulated panels are placed end to end, with the first respective opposed panel end of one panel abutting the second respective opposed panel end of the other panel, the hook assembly on the one panel engages the pin assembly on the other panel to hold the two panels together;

wherein at least one of the inner and outer planar skins on the first end face includes an extension which lies in the plane of the respective one planar skin and extends beyond the respective first end face, and the same one of the inner and outer planar skins on the second end face defines a shoulder and a recess indented inwardly from the plane of said one planar skin so that the extension on the first end face of one panel can be received in the recess on the second end face of an identical adjacent panel so that, when the adjacent panels are brought together and locked together by the respective hook assemblies and pin assemblies, the extension on one panel has an edge that lies adjacent to the shoulder on the adjacent panel such that a weld can be made along the edge and shoulder to weld the two adjacent panels together, with the respective planar skin being flat and continuous along both of the two adjacent panels.

2. An insulated panel arrangement as recited in claim 1, wherein said pin assembly includes a pin defining an inner end portion and an outer end portion, said pin lying between and extending perpendicular to said inner and outer planar skins; and inner and outer pin support members which are located in said interior space and which support said pin;

each of said inner and outer pin support members having an end surface which bears against the second opposed end face of one of the planar skins;

and wherein said hook assembly includes two spaced-apart hooks mounted for rotation on a rod, said rod defining an inner end portion and an outer end portion and lying between and extending perpendicular to said inner and outer planar skins; and inner and outer rod support members which support said rod;

each of said inner and outer rod support members having an end surface which bears against the first opposed end face of one of the planar skins;

wherein at least a portion of the end surface of said inner rod support member is directly opposite the end surface of said inner pin support member, and at least a portion of the end surface of said outer rod support member is directly opposite the end surface of the outer pin support member.

3. An insulated panel arrangement as recited in claim 2, wherein the inner and outer bent edges of the planar skins are spaced apart from each other, and further comprising a plurality of discrete, individual spacers secured to the inner and outer bent edges on at least one end face to maintain the inner and outer planar skins in uniform spaced apart relationship.

4. An insulated panel arrangement as recited in claim 3, wherein both of the pin support members have an end surface which bears against the second opposed end face of the same planar skin, and both of the rod support members have an end surface which bears against the first opposed end face of the same planar skin.

5. An insulated panel arrangement as recited in claim 4, wherein the end face of the planar skin against which both of said rod support members bear defines a slotted opening aligned with the hook to permit the hook to extend through that end face.

6. A method for building an enclosed, insulated structure, comprising the steps of:

providing a plurality of insulated panels, each having a pair of opposed left and right panel ends including left and right end faces and a pair of opposed top and bottom panel ends including top and bottom end faces, said insulated panel including parallel, spaced-apart inner and outer planar skins defining an interior space between said inner and outer planar skins, and an insulated core extending between said inner and outer planar skins and generally filling said interior space, wherein said end faces are perpendicular to the inner and outer planar skins; a hook assembly at a first of said respective left and right opposed panel ends; and a mating pin assembly at a second of said left and right opposed panel ends, wherein at least one of said planar skins;

wherein at least one of the inner and outer planar skins on the first end face includes an extension which lies in the plane of the respective one planar skin and extends beyond the respective first end face, and the same one of the inner and outer planar skins on the second end face defines a shoulder and a recess indented inwardly from the plane of said one planar skin;

bringing the left panel end of a first of said panels into alignment with the right panel end of a second of said panels;

hooking the hook assembly of the first of said panels into the pin assembly of the second of said panels in order to tie the first and second panels snugly together, with the extension on one of the first and second panels being received in the recess on the other of the first and second panels, with an edge of the extension on the one panel lying adjacent to the shoulder on the second panel; and then welding the extension on the one panel to the planar skin on the other panel along the edge and shoulder to weld the two adjacent panels together, with the respective planar skin being flat and continuous along both of the two adjacent panels.

* * * * *